US008182365B2

(12) United States Patent
Wada et al.

(10) Patent No.: US 8,182,365 B2
(45) Date of Patent: May 22, 2012

(54) GOLF CLUB HEAD

(75) Inventors: Kozue Wada, Chichibu (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 11 days.

(21) Appl. No.: 12/837,684

(22) Filed: Jul. 16, 2010

(65) Prior Publication Data

US 2011/0014995 A1 Jan. 20, 2011

(30) Foreign Application Priority Data

Jul. 17, 2009 (JP) ..... 2009-169567

(51) Int. Cl.
*A63B 53/04* (2006.01)

(52) U.S. Cl. ..... 473/344; 473/345; 473/349

(58) Field of Classification Search ..... 473/324–350, 473/287–292, 219–256
See application file for complete search history.

(56) References Cited

U.S. PATENT DOCUMENTS

| | | | | |
|---|---|---|---|---|
| 5,213,328 | A * | 5/1993 | Long et al. | 473/346 |
| 5,316,298 | A * | 5/1994 | Hutin et al. | 473/332 |
| 5,908,356 | A | 6/1999 | Nagamoto | |
| 6,248,025 | B1 * | 6/2001 | Murphy et al. | 473/324 |
| 6,494,790 | B1 * | 12/2002 | Toyota et al. | 473/345 |
| 6,572,491 | B2 | 6/2003 | Hasebe et al. | |
| 6,612,938 | B2 * | 9/2003 | Murphy et al. | 473/324 |
| 6,949,031 | B2 | 9/2005 | Imamoto et al. | |
| 7,156,750 | B2 | 1/2007 | Nishitani et al. | |
| 7,160,205 | B2 * | 1/2007 | Yamamoto | 473/345 |
| 7,316,624 | B2 * | 1/2008 | Sanchez | 473/345 |
| 7,377,861 | B2 | 5/2008 | Tateno et al. | |
| 7,390,271 | B2 | 6/2008 | Yamamoto | |
| 7,431,668 | B2 | 10/2008 | Tateno et al. | |
| 7,435,191 | B2 | 10/2008 | Tateno et al. | |
| 7,455,597 | B2 | 11/2008 | Matsunaga | |
| 7,503,853 | B2 | 3/2009 | Matsunaga | |
| 7,513,836 | B2 | 4/2009 | Matsunaga | |
| 7,568,984 | B2 | 8/2009 | Matsunaga | |
| 7,588,504 | B2 | 9/2009 | Matsunaga | |
| 2003/0087710 | A1 * | 5/2003 | Sheets et al. | 473/344 |
| 2005/0221913 | A1 * | 10/2005 | Kusumoto | 473/345 |
| 2007/0049409 | A1 | 3/2007 | Matsunaga | |
| 2007/0149313 | A1 * | 6/2007 | Matsunaga et al. | 473/332 |

FOREIGN PATENT DOCUMENTS

| | | | |
|---|---|---|---|
| JP | 10-024128 | A | 1/1998 |
| JP | 11-155982 | A | 6/1999 |
| JP | 2003-093556 | A | 4/2003 |
| JP | 2003-093559 | A | 4/2003 |
| JP | 2003-102877 | A | 4/2003 |
| JP | 2004-065660 | A | 3/2004 |
| JP | 2004-222792 | A | 8/2004 |
| JP | 2004-229820 | A | 8/2004 |
| JP | 2006-204604 | A | 8/2006 |

(Continued)

*Primary Examiner* — Sebastiano Passaniti
(74) *Attorney, Agent, or Firm* — Sughrue Mion, PLLC

(57) ABSTRACT

A golf club head according to this invention is a hollow golf club head including a face portion, a crown portion, and a sole portion. The sole portion includes a first region which starts from the boundary portion between the sole portion and the face portion, and a second region which is spaced apart from the boundary portion toward the back side, and is adjacent to the first region. The second region is thinner than the first region and a third region adjacent to the back-side periphery of the second region. The second region includes the position of an antinode of the primary vibration mode of the sole portion at the time of impact.

10 Claims, 6 Drawing Sheets

FOREIGN PATENT DOCUMENTS

| | | | |
|---|---|---|---|
| JP | 3854066 | B2 | 9/2006 |
| JP | 2007-054195 | A | 3/2007 |
| JP | 2007-054198 | A | 3/2007 |
| JP | 2007-054199 | A | 3/2007 |
| JP | 2007-054200 | A | 3/2007 |
| JP | 2007-083011 | A | 4/2007 |
| JP | 2007-151758 | A | 6/2007 |

* cited by examiner

| | W1 (mm) | W2 (mm) | W3 (mm) | NATURAL FREQUENCY (Hz) |
|---|---|---|---|---|
| #1 | 41 | 35 | 40 | 3084 |
| #2 | 37 | 39 | | 3174 |
| #3 | 33 | 43 | | 3246 |
| #4 | 30 | 46 | | 3183 |
| #5 | 26 | 50 | | 3094 |
| #6 | 23 | 53 | | 2982 |
| #7 | 19 | 57 | | 2873 |
| #8 | 37 | 39 | | 3166 |

GOLF CLUB HEAD

BACKGROUND OF THE INVENTION

1. Field of the Invention

The present invention relates to a golf club head and, more particularly, to a technique to improve an impact sound.

2. Description of the Related Art

In hollow golf club heads typified by a driver head, methods of improving, for example, an impact feel, an impact sound, and a total distance performance of a shot in accordance with the hollow body construction have been proposed (for example, Japanese Patent Laid-Open Nos. 11-155982, 2007-151758, 2007-83011, 2007-54195, 2007-54198, 2007-54199, 2007-54200, 2004-229820, 2004-222792, and 2004-65660). Japanese Patent Laid-Open Nos. 11-155982 and 2007-151758 disclose golf club heads in which especially an impact feel and an impact sound are improved in accordance with the hollow body thickness.

The volume of a hollow golf club head increases every year, while the crown and sole portion become thinner, and the head area increases together with this trend. This makes it likely for a low-pitched sound to be generated at the time a golf ball is struck. Under the circumstance, golfers who prefer high-pitched sounds want golf club heads that generate higher-pitched sounds.

SUMMARY OF THE INVENTION

It is an object of the present invention to provide a golf club head that generates a higher-pitched sound despite its large head volume.

According to the present invention, there is provided a hollow golf club head including a face portion, a crown portion, and a sole portion, wherein the sole portion includes a first region which starts from a boundary portion between the sole portion and the face portion, and a second region which is spaced apart from the boundary portion toward a back side, and is adjacent to the first region, the second region is thinner than the first region and a third region adjacent to a back-side periphery of the second region, and the second region includes a position of an antinode of a primary vibration mode of the sole portion at a time of impact.

Further features of the present invention will become apparent from the following description of exemplary embodiments with reference to the attached drawings.

DESCRIPTION OF THE EMBODIMENTS

Figure 1:
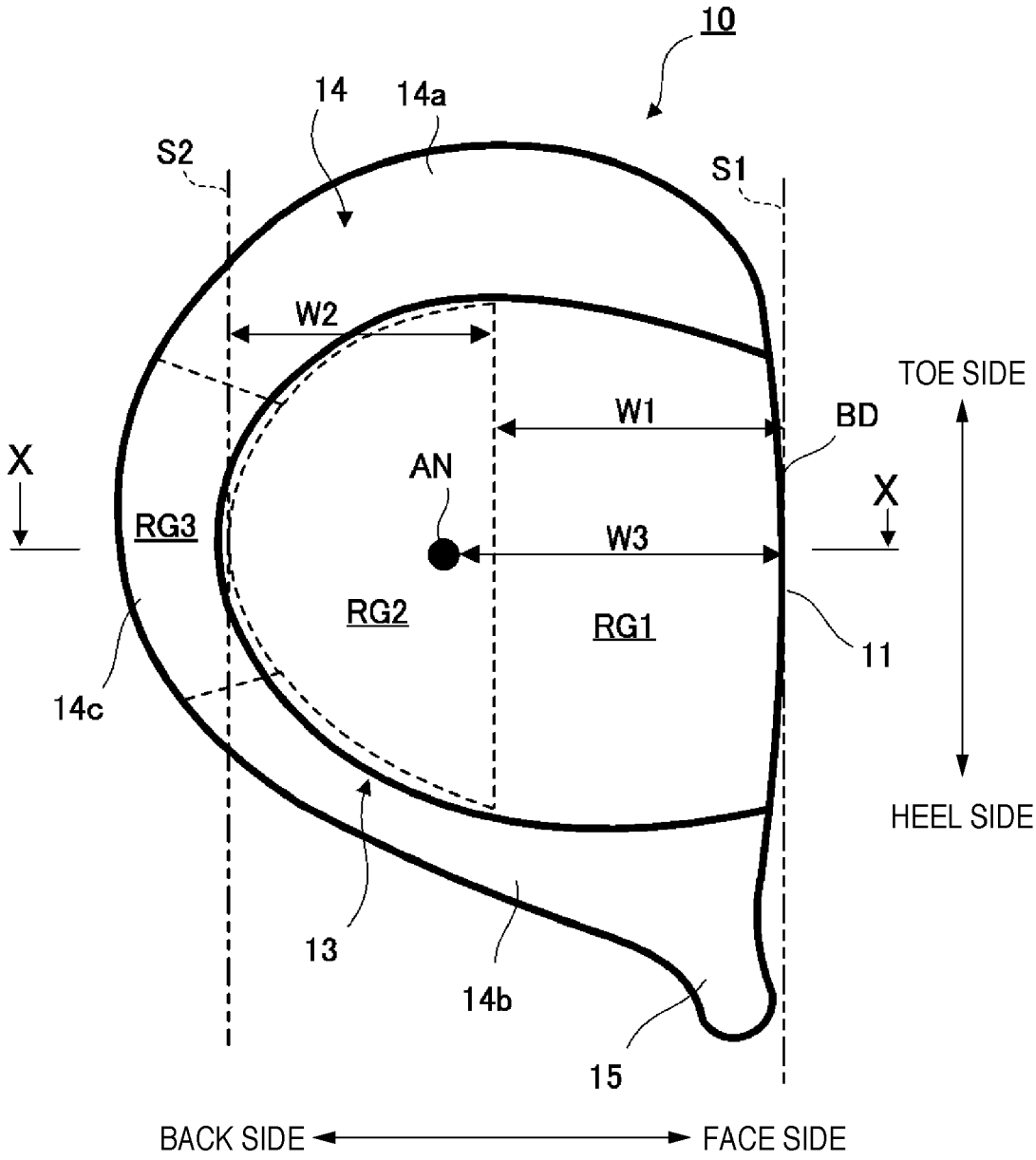
FIG. 1 is a view showing a golf club head 10 according to one embodiment of the present invention when viewed from the side of a sole portion 13.
Figure 2:
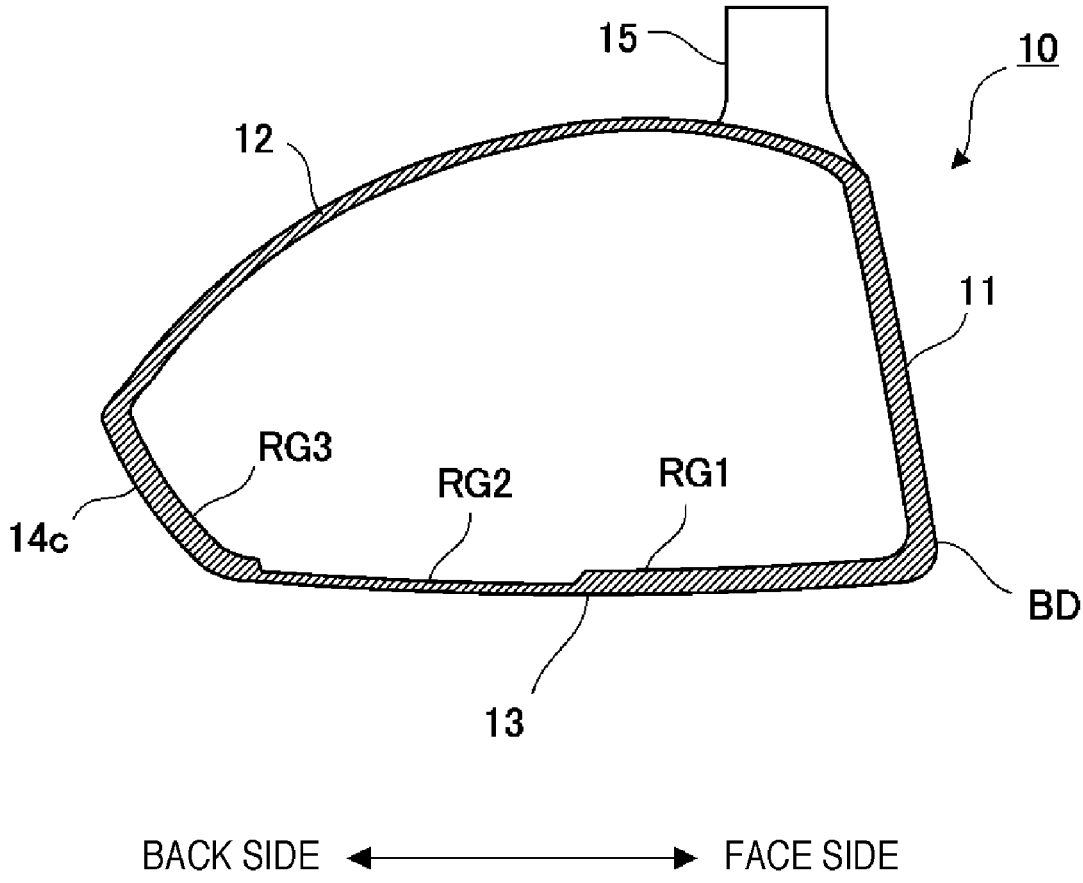
FIG. 2 is a sectional view taken along a line X-X in FIG. 1.

FIG. 1 is a view showing a golf club head 10 according to one embodiment of the present invention when viewed from the side of a sole portion 13, and FIG. 2 is a sectional view taken along a line X-X in FIG. 1. The golf club head 10 takes the form of a hollow body, and its peripheral wall serves as a face portion 11, a crown portion 12, the sole portion 13, and a side portion 14. The face portion 11 forms a face (striking face). The crown portion 12 forms the upper portion of the golf club head 10. The sole portion 13 forms the bottom portion of the golf club head 10. The side portion 14 forms the side portion of the golf club head 10. The side portion 14 includes a toe-side portion 14*a*, heel-side portion 14*b*, and back-side portion 14*c*. The golf club head 10 also includes a hosel portion 15 in which a shaft is fitted.

The golf club head 10 is a driver golf club head. However, the present invention is applicable not only to driver golf club heads but also to wood type golf club heads including, for example, a fairway wood type golf club head, utility (hybrid) golf club heads, and other hollow golf club heads. The golf club head 10 can be made of a metal material such as a titanium-based metal (for example, Ti-6Al-4V titanium alloy), stainless steel, or a copper alloy such as beryllium copper.

The golf club head 10 can be assembled by bonding a plurality of parts. The golf club head 10 can be formed from, for example, a main body member and a face member. The main body member forms the peripheral portions of the crown portion 12, sole portion 13, side portion 14, and face portion 11, and has an opening partially formed in a portion corresponding to the face portion 11. The face member is fitted into the opening in the main body member.

The sole portion 13 has regions RG1 and RG2 with different thicknesses formed in it. The region RG1 starts from a boundary portion BD between the sole portion 13 and the face portion 11, and extends toward the back side. The region RG2 is surrounded by a broken line in FIG. 1. The region RG2 is spaced apart from the boundary portion BD toward the back side by a distance W1, and is adjacent to the region RG1. In case of the example shown in FIGS. 1 and 2, the region RG2 starts from the back-side edge of the region RG1.

Also, a region RG3 surrounded by a broken line is formed from the back-side periphery of the sole portion 13 to the back-side portion 14*c*. The thicknesses of the regions RG1 to RG3 have relations: Region RG1>Region RG2, and Region RG3>Region RG2. That is, the region RG2 is thinnest among the regions RG1 to RG3. The region RG2 includes a position AN of an antinode of the primary vibration mode of the sole portion 13 at the time of impact.

In this manner, according to this embodiment, because the thick region RG1, the thin region RG2, and the thick region RG3 are formed in turn from the face side to the back side, the sole portion 13 is likely to vibrate at high frequencies at the time of striking a golf ball. Especially because the thin region RG2 includes the position AN of an antinode of the primary vibration mode of the sole portion 13, the thick regions RG1 and RG3 are less likely to vibrate and the thin region RG2 is likely to vibrate, so the sole portion 13 is likely to vibrate at high frequencies.

In this embodiment, a higher-pitched sound can thus be generated despite its large head volume. The head volume is, for example, 350 cc (inclusive) to 500 cc (inclusive). In general, with an increase in head volume, the thickness of a sole portion needs to get thinner, so the eigenvalue of the entire head decreases, and the eigenvalue of the primary vibration mode of the sole portion, in turn, decreases. Thus, a low-pitched sound is likely to be generated at the time of striking a golf ball in that case, but the impact sound can be improved by adopting the construction according to this embodiment. Note that the position AN of an antinode of the primary vibration mode of the sole portion 13 can be obtained by modal analysis using a computer or eigenvalue analysis using the FEM.

Figure 3A:
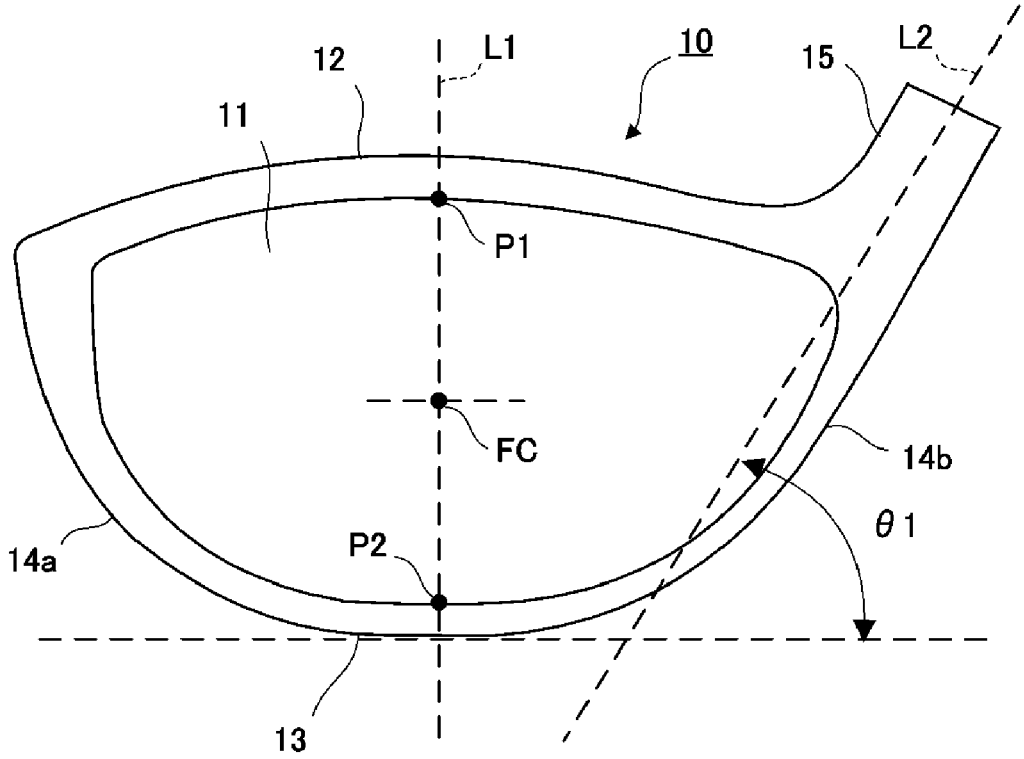
FIG. 3A is a front view of the golf club head 10 when viewed from the side of a face portion 11.
Figure 3B:
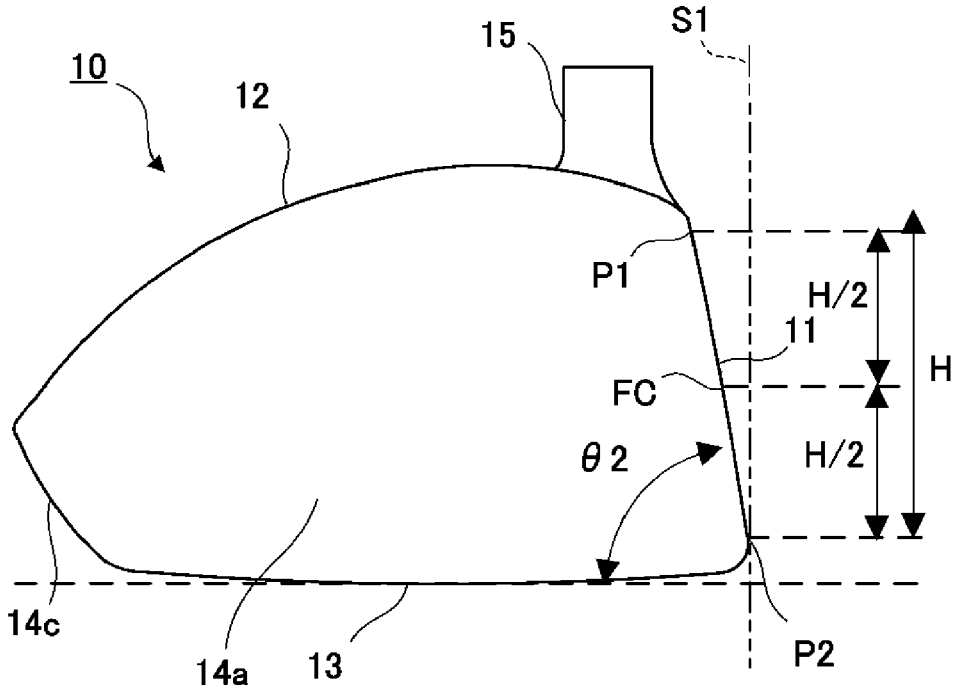
FIG. 3B is a side view of the golf club head 10.

The distance W1 and distances W2 and W3 will be described next. For the sake of convenience, a face center will be described first with reference to FIGS. 3A and 3B. Referring to FIG. 3A, an angle θ1 is a lie angle, which a shaft line L2 of a shaft fitted into the hosel portion 15 makes with the ground surface. Referring to FIG. 3B, an angle θ2 is a loft angle, which the face portion 11 makes with the ground surface. Referring to FIG. 3A again, a line L1 runs through the central line of the grounded portion in the toe-to-heel direction, as shown in FIG. 3A, when the golf club head 10 is in contact with the ground surface at a prescribed lie angle and a prescribed loft angle. The positions of the upper and lower ends of the face portion 11, which intersect with the line L1, are defined as positions P1 and P2, respectively, and a position with a height half a height difference H between the positions P1 and P2 is defined as a face center FC.

Referring to FIGS. 1, 3A and 3B, a virtual plane S1 is a vertical plane which includes the position P2, shown in FIGS. 3A and 3B, when the golf club head 10 is in contact with the ground surface at a prescribed lie angle and a prescribed loft angle, and is perpendicular to the flight trajectory direction. The flight trajectory direction is a horizontal direction included in a vertical plane including a normal to the face portion 11 at the face center FC. The face-to-back direction is a direction parallel to the flight trajectory direction, and the toe-to-heel direction is a direction perpendicular to the face-to-back direction.

Referring to FIG. 1, the distance W1 is the distance between the virtual plane S1, and a plane that includes a point closest to the face in the region RG2 and is parallel to the virtual plane S1. The distance W2 is the distance between a plane which includes a point closest to the face in the region RG2 and is parallel to the virtual plane S1, and a plane S2 which includes a point closest to the back in the region RG2 and is parallel to the virtual plane S1. The distance W2 is equal to the length of the region RG2 in the face-to-back direction. The distance W3 is equal to the length of a line dropped from the virtual plane S1 to the position AN of an antinode.

In the example shown in FIG. 1, the region RG2 is formed starting from a position spaced apart from the virtual plane S1 by the distance W1 in the sole portion 13, and extends over almost the entire region of the sole portion 13 on both the toe and heel sides from this position to the back side. In other words, the region RG2 is formed in nearly a half of the sole portion 13 on the back side.

Each of the regions RG1, RG2, and RG3 may have a uniform thickness or include portions with different thicknesses. If these regions have portions with different thicknesses, each portion in the region RG2 is preferably thinner than each of portions in the regions RG1 and RG3, so each portion in the region RG2 is made thinner than at least each of portions, adjacent to each portion in the region RG2, in the regions RG1 and RG3.

The toe-side portion 14*a* and heel-side portion 14*b* in the side portion 14 preferably have thicknesses, in at least portions adjacent to the region RG2, which are equal to or larger than that of the region RG2.

The ratio between the thicknesses of the regions RG1 and RG2 preferably is, for example, 1:0.6 to 2.1, and that of the regions RG3 and RG2 preferably is, for example, 1:0.8 to 1.2.

Figure 4B:
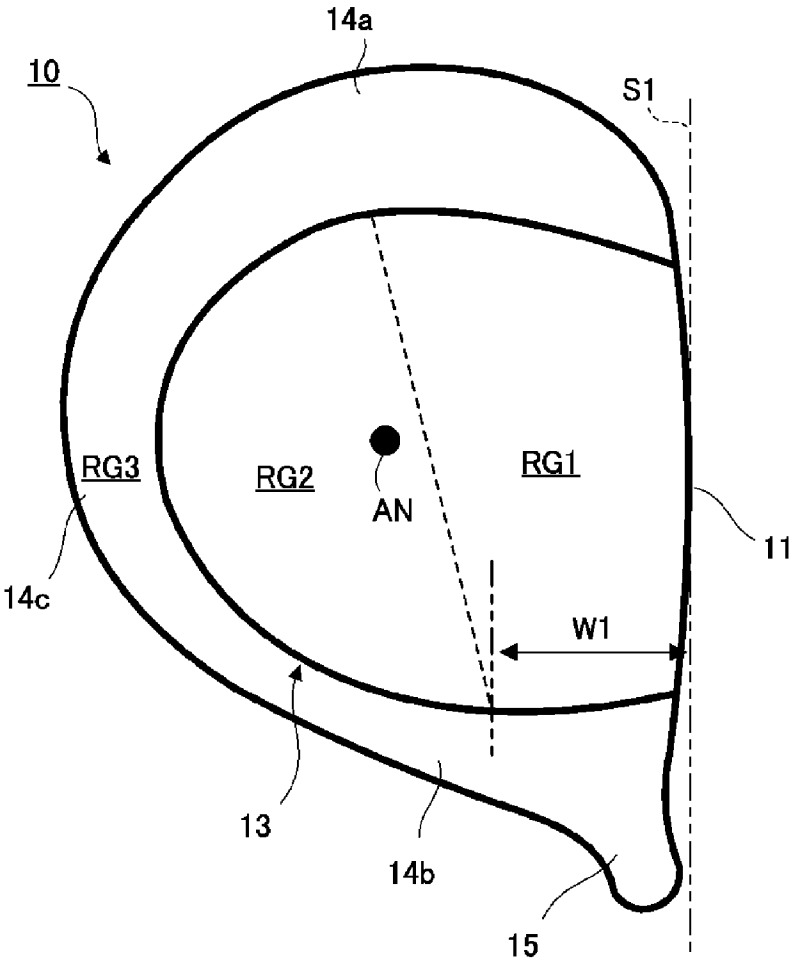
FIGS. 4A and 4B are views illustrating examples of other ranges of a region RG2.
Figure 4A:
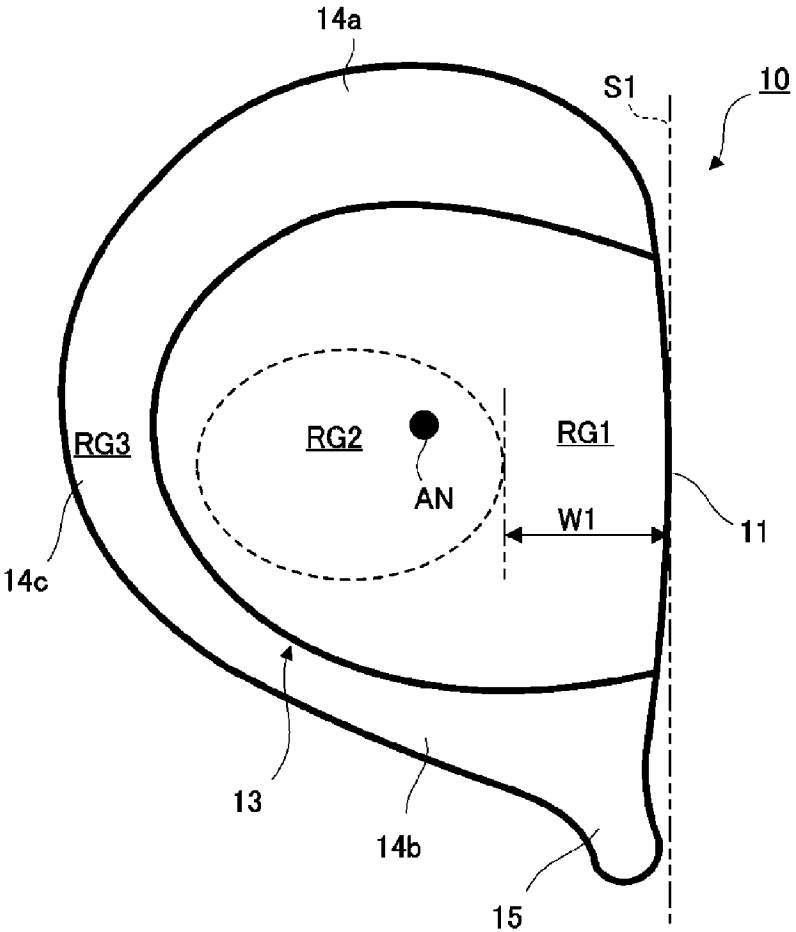

The range of the region RG2 is not limited to that shown in FIG. 1, and various ranges can be selected. FIGS. 4A and 4B are views illustrating examples of other ranges of the region RG2. In the example shown in FIG. 4A, the region RG2 has an elliptical shape. The region RG3 in the sole portion 13 has a range wider in the example shown in FIG. 4A than in the example shown in FIG. 1. FIG. 4B illustrates an example in which the boundary line between the regions RG2 and RG1 is not equidistant from the virtual plane S1 throughout its whole length.

EXAMPLE

Figures 5A, 5B:
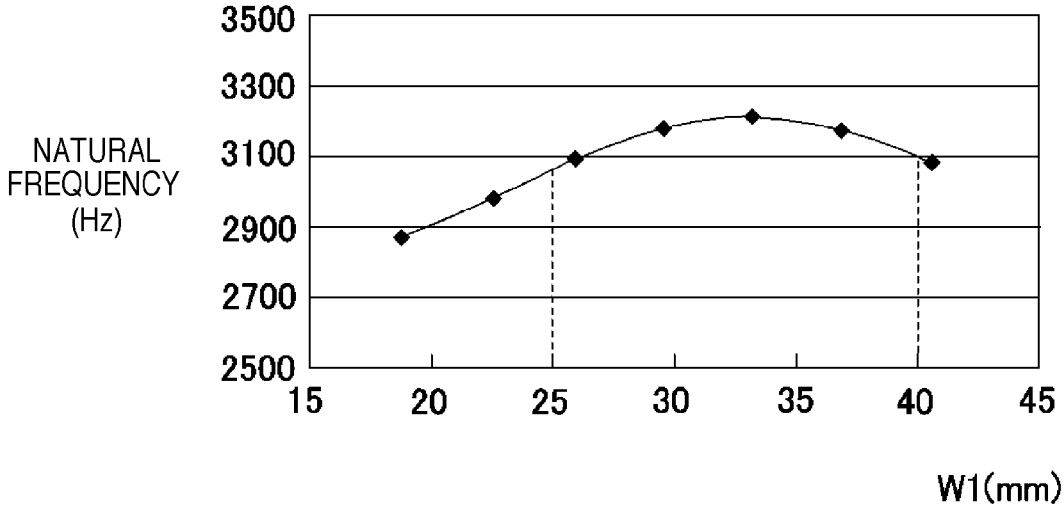
FIG. 5A is a table showing the specifications of golf club heads #1 to #8.
FIG. 5B is a graph showing the relationship between a distance W1 and the natural frequency with regard to golf club heads #1 to #7.
Figure 6:
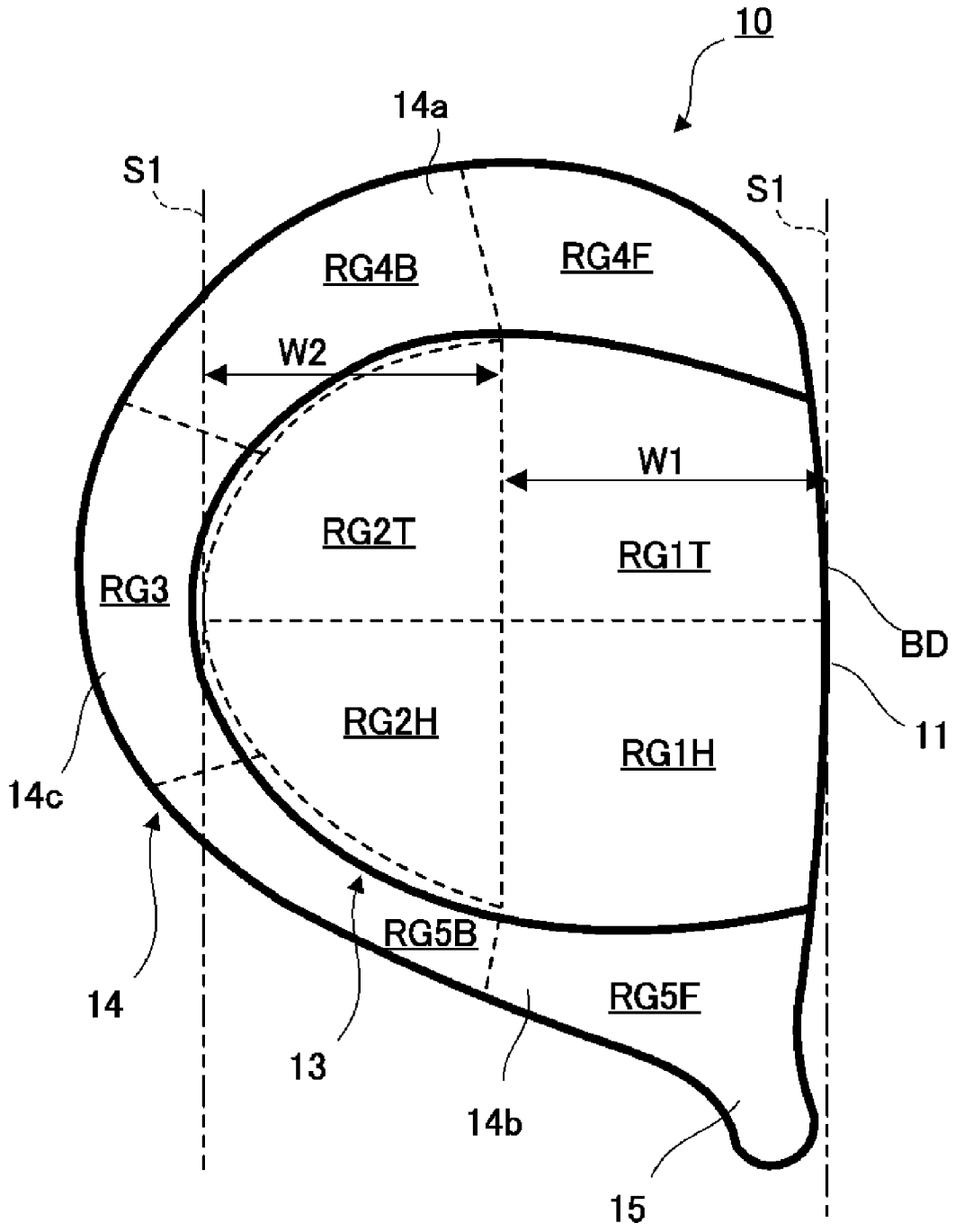
FIG. 6 is an explanatory view of golf club heads #1 to #8.

Models of a plurality of golf club heads #1 to #8 with different distances W1 were designed on a computer, and vibration analysis was performed for each model on the computer. FIG. 5A is a table showing the specifications of golf club heads #1 to #8. FIG. 5B is a graph showing the relationship between the distance W1 and the natural frequency (primary vibration mode) with regard to golf club heads #1 to #7. FIG. 6 is an explanatory view of golf club heads #1 to #8.

FIG. 6 is a view showing golf club heads #1 to #8 when viewed from the sides of their sole portions 13. Each of golf club heads #1 to #8 is a driver head with a volume of 453 cc, and is made of a titanium alloy (Ti-6Al-4V). Golf club heads #1 to #8 have different distances W1 and, hence, different distances W2 and W3. In golf club heads #1 to #8, regions RG1 and RG2 as shown in FIG. 1 are divided into toe-side regions RG1T and RG2T and heel-side regions RG1H and RG2H. Also, a toe-side portion 14*a* of a side portion 14 is divided into a face-side region RG4F and a back-side region RG4B. Moreover, a heel-side portion 14*b* of the side portion 14 is divided into a face-side region RG5F and a back-side region RG5B.

Note that the boundaries between the regions RG4F and RG4B and between the regions RG5F and RG5B are continuous with that between the regions RG1 and RG2, and these boundary positions change with a change in distance W1.

The thicknesses of each region and each portion are as follows.

| | #1 to #7 | #8 |
|---|---|---|
| Region RG1T | 1.4 mm | |
| Region RG1H | 1.4 mm | |
| Region RG2T | 0.6 mm | 0.7 mm |
| Region RG2H | 0.7 mm | 0.6 mm |
| Region RG3 | 1.3 mm | 1.4 mm |
| Region RG4F | 1.3 mm | 0.9 mm |
| Region RG4B | 0.7 mm | 1.2 mm |
| Region RG5F | 1.1 mm | 0.9 mm |
| Region RG5B | 1.1 mm | 1.2 mm |
| Face Portion | 3.0 mm | |
| Crown Portion | 0.7 mm | |

The thicknesses of the regions RG4B and RG5B are preferably thinner than the thickness of the region RG3 such as golf club heads #1 to #8. The thicknesses of the regions RG4B and RG5B are preferably thicker than the thicknesses of the regions RG2T and RG2H such as golf club head #8.

FIG. 5A shows the distances W1 to W3 of golf club heads #1 to #8. Golf club head #1 has a longest distance W1, whereas golf club head #7 has a shortest distance W1. Thus, golf club head #1 has regions RG1, RG4F, and RG5F with relatively large areas, and regions RG2, RG4B, and RG5B with relatively small areas, whereas golf club head #7 has regions RG1, RG4F, and RG5F with relatively small areas, and regions RG2, RG4B, and RG5B with relatively large areas. The distances W1 to W3 of golf club head #8 are equal to those of golf club head #2.

FIG. 5A shows the natural frequencies of the primary vibration modes of golf club heads #1 to #8 as an analysis result. FIG. 5B is a graph which shows the distance W1 on the abscissa, and the natural frequency (primary vibration mode) on the ordinate with regard to golf club heads #1 to #7. Note that vibration analysis was performed by computation using the FEM.

As can be seen by referring to FIG. 5B, as the distance W1 increases, the natural frequency increases and then decreases. The inventors of this invention examined the cause of this characteristic, and concluded that if the distance W1 is too short (the distance W2 is too long), the region RG2 has a large area and, hence, an area which is likely to vibrate, so high-frequency vibration cannot be obtained. The inventors of this invention also concluded that if the distance W1 is too long, the thick region RG1 includes the position of an antinode of a primary vibration mode, so the sole portion 13 is less likely to vibrate at high frequencies due to the influence of the weight of the thick region RG1 (the region RG1 has a weight per unit area larger than the region RG2). When an impact sound with a frequency of about 3,000 Hz is assumed as a high-pitched sound, the distance W1 preferably is 25 mm (inclusive) to 40 mm (inclusive). Also, the distance W2 in this case preferably is 20 mm or less.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-169567, filed Jul. 17, 2009, which is hereby incorporated by reference herein in its entirety.

What is claimed is:

1. A hollow golf club head including a face portion, a crown portion, and a sole portion, wherein the sole portion includes a first region which starts from a boundary portion between the sole portion and the face portion, and a second region which is spaced apart from the boundary portion toward a back side, and is adjacent to said first region, said second region is thinner than said first region and a third region adjacent to a back-side periphery of said second region, and said second region includes a position of an antinode of a primary vibration mode of the sole portion at a time of impact that is distant from the transition between the first region and the second region.

2. The head according to claim 1, wherein a distance from the boundary portion to said second region is 25 mm (inclusive) to 40 mm (inclusive).

3. The head according to claim 1, wherein a head volume is not less than 350 cc.

4. The head according to claim 1, wherein a length of said thin, second region in a face-to-back direction is not more than 20 mm.

5. The head according to claim 1, wherein the third region is disposed on a side of the golf club head between the sole portion and the crown portion.

6. The head according to claim 1, wherein the second region extends along the sole portion from the first region to a side of the golf club.

7. The head according to claim 1, further comprising a side portion, wherein said side portion includes a back-side portion, a heel-side portion and a toe-side portion, and the third region is disposed on the back-side portion.

8. The head according to claim 7, wherein said toe-side portion includes a first face-side region and a first back-side region, said heel-side portion includes a second face-side region and a second back-side region, boundaries between the first face-side region and the first back-side region and between the second face-side region and the second back-side region are continuous with a boundary between the first and second regions, and the first and second back-side regions are thinner than the third region.

9. The head according to claim 7, wherein said toe-side portion includes a first face-side region and a first back-side region, said heel-side portion includes a second face-side region and a second back-side region, boundaries between the first face-side region and the first back-side region and between the second face-side region and the second back-side region are continuous with a boundary between the first and second regions, and the first and second back-side regions are thicker than the second region.

10. The head according to claim 7, wherein said toe-side portion includes a face-side region and a back-side region, a boundary between the face-side region and the back-side region is continuous with a boundary between the first and second regions, and the back-side region is thinner than the face-side region and the third region.

* * * * *